United States Patent [19]

Mewissen

[11] 4,443,778

[45] Apr. 17, 1984

[54] ADAPTER FOR A LOW-VOLTAGE LAMP

[75] Inventor: Jan A. C. Mewissen, Eindhoven, Netherlands

[73] Assignee: U.S. Philips Corporation, New York, N.Y.

[21] Appl. No.: 394,736

[22] Filed: Jul. 2, 1982

[30] Foreign Application Priority Data

Jul. 29, 1981 [NL] Netherlands ..... 8103571

[51] Int. Cl.[3] ..... H01F 27/02

[52] U.S. Cl. ..... 336/90; 336/107

[58] Field of Search ..... 336/90, 107, 65, 192, 336/208

[56] References Cited

U.S. PATENT DOCUMENTS 1,005,163 10/1911 Conrad ..... 336/90

1,274,380 8/1918 Brislin ..... 336/107

*Primary Examiner*—J. V. Truhe

*Assistant Examiner*—Susan Steward

*Attorney, Agent, or Firm*—Robert S. Smith

[57] ABSTRACT

An adaptor for the connection of a low-voltage lamp to mains voltage has a housing with an assembly member which has a flange and a tubular part. The tubular part projects through an aperture in the housing and is connected to a lamp cap. The lamp cap and the flange retain the housing in position. A ring core transformer is present in the housing around the tubular part. The assembly member bears a lamp holder for a low voltage lamp.

9 Claims, 2 Drawing Figures

ADAPTER FOR A LOW-VOLTAGE LAMP

BACKGROUND OF THE INVENTION

The invention relates to an adaptor for a low-voltage lamp comprising a housing having at one end a lamp cap for connecting the adaptor to a line voltage lamp holder, and also comprising a lamp holder for a low-voltage lamp, in which housing a transformer is incorporated the primary of which is connected to the lamp cap by current conductors and the secondary of which is connected to the lamp holder by current conductors. Such an adaptor is known inter alia from DE-OS No. 2804586.

The adaptor enables the operation of low-voltage lamps from a line voltage supply. When the adaptor has a lamp cap which fits in the lamp holder which are usually used for line voltage lamps, mains voltage lamps may be exchanged at will for low voltage lamps which generally have an operating voltage of approximately 6 to approximately 42 volts and have lamp caps such as E27, E26, E14, or B22 lamp caps.

The use of low-voltage incandescent lamps has in many cases advantages over the use of line voltage incandescent lamps. For example low-voltage incandescent lamps may be given a smaller power than line voltage lamps, while the filament nevertheless is mechanically strong. This is of importance in particular in highly loaded lamps, such as halogen incandescent lamps.

Another advantage of low voltage incandescent lamps is that the filament is very much smaller than the filament of line voltage lamps of the same power. As a result of this it is possible when using said lamps to form a narrower light beam by means of a reflector. Low voltage lamps are therefore particularly suitable for use to obtain accent illumination.

It is the object of the invention to provide an adaptor of a simple construction which enables a very rapid and easy assembly.

SUMMARY OF THE INVENTION

In the adaptor of the kind mentioned in the opening paragraph this object is achieved in that the transformer is a ring core transformer and that the adaptor includes an assembly member which has a tubular part and a flange at one end, which assembly member carries the lamp holder and is partly contained in the housing, the tubular part of which assembly member is surrounded by the transformer and at its end remote from the flange projects through an aperture in the housing and is there secured to the lamp cap, the flange of the assembly member bearing against the housing in the longitudinal direction of the tubular part so that the housing is retained in position by the lamp cap and the flange.

The lamp cap may be connected to the assembly member in various manners. The assembly member may have screw thread on which an Edison lamp cap is screwed. On the other hand it is possible to indent the lamp cap locally in recesses in the assembly member. Another possibility is to provide the tubular part of the assembly member with a circumferential groove, providing a resilient metal ring and welding or soldering the lamp cap to said ring. For making a welded joint a laser, for example, may be used. Another possibility is to realize the connection by means of glue. A screwed lamp cap may be locked, if desired, for example by making an indentation, a welded joint or a soldered joint, for example with a ring, or by the use of glue. It is also possible to lock the lamp cap by means of solder which forms a wedge in a groove in the tubular part of the assembly member.

When an Edison lamp cap is used, a screwed connection, if desired locked by gluing or indenting the lamp cap, has proved to be very attractive.

The flange of the assembly member may be present within the housing and in the longitudinal direction of the tubular part bear there against one or more projections extending from the wall of the housing inwardly or present on an edge in the wall of the housing. However, the flange may on the other hand be present entirely or partly outside the housing. The flange may have means, such as projections or a recessed edge, to keep the housing centered with respect to the assembly member. This embodiment is attractive because the inner surface of the wall of the housing in that case needs no profile to provide a seat for the flange of the assembly member.

The lamp holder may be mounted on the side of the flange of the assembly member remote from the transformer. The adaptor may be constructed to be more compact when the lamp holder is released into the tubular part of the assembly member. In an attractive embodiment the lamp holder has a flange which bears against the flange of the assembly member. The assembly member may hae one or more projections which extend through the flange of the lamp holder. If desired, the flange may be locked, for example, by deforming the projections, or with other means, such as a locking ring, for example a scraping ring. In an embodiment, holes are formed in the flange of the lamp holder having lugs along their edges so that flange and scraping rings are integrated.

The lamp holder may be an Edison or a Swan lamp holder, or a lamp holder for a lamp having plug pins.

In a favorable embodiment the flange of the assembly member on its side remote from the transformer has a collar for receiving a screening cap. Such a cap may prevent the radiation of stray light. The shoulder and the screening cap may have means to form together a coupling, for example, a bayonet coupling, a screw coupling, a snap coupling, or a clamping coupling.

In a favourable embodiment the tubular part of the assembly member has an aperture in its wall through which current conductors are passed to the lamp and/or to the lamp holder.

Generally, in order to promote the electric safety of the adaptor, ceramic and/or a synthetic resin are used for the manufacture of the assembly member and the housing. Thermoplasts and thermo-hardeners may be used.

Lamps having a reflector will generally be used in the adaptor, in particular halogen lamps having a reflector. For reasons of safety the reflector may be closed by means of a cover glass. The cover glass may have another useful function. By using a frosted or satined cover glass, very narrow light beams (for example $2\times3°$) can be more or less widened (for example up to $2\times7°$). When a certain object has to be illuminated entirely from a larger distance, a cover glass yielding the narrower beam if the same object has to be irradiated entirely from a shorter distance, a coverglass giving a wider beam is used.

The core, if the ring core transformer may be a closed, O-shaped ring or, alternatively, an open, C-shaped ring. The latter kind of transformer has the advantage of being easier to manufacture.

BRIEF DESCRIPTION OF THE DRAWING

Embodiments of an adaptor according to the invention are shown in the drawings. In the drawings.

DESCRIPTION OF THE PREFERRED EMBODIMENTS

Figure 1:
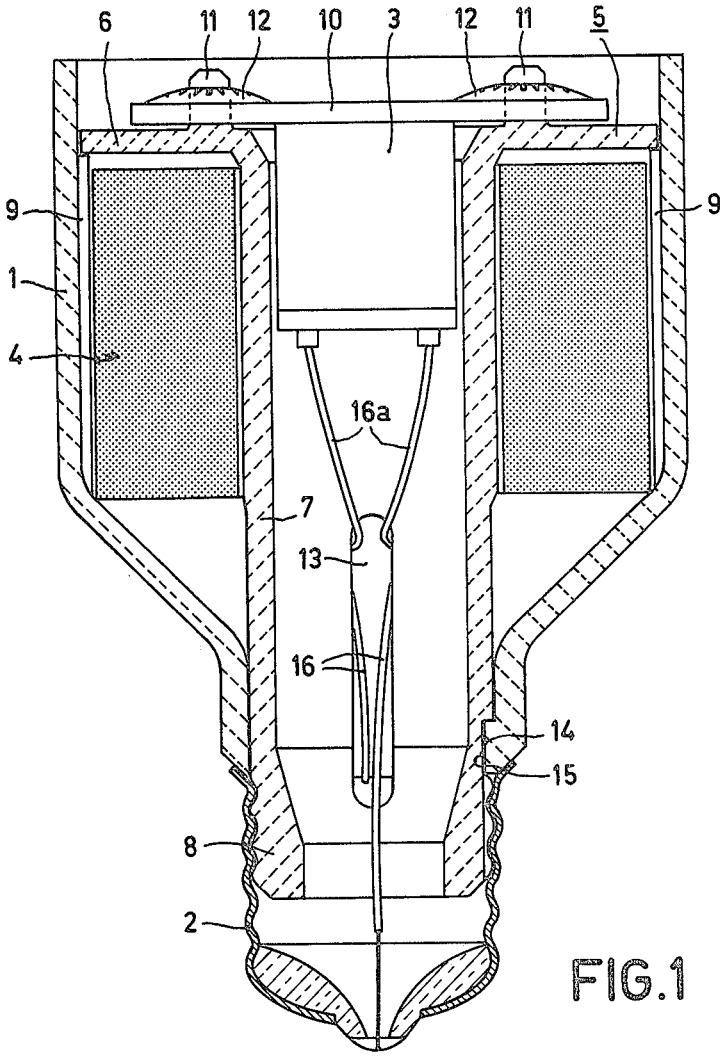
FIG. 1 shows a first embodiment for the greater part as a longitudinal sectional view.

In FIG. 1, an assembly member 5, which has a tubular part 7 and a flange 6, is present in a housing 1 of a synthetic resin. Also present in the housing 1 is a ring core transformer 4 (shown diagrammatically in the Figure) which surrounds the tubular part 7. The end 8 of the tubular part 7 remote from the flange 6 projects through an aperture in the housing 1. The end 8 has a screwthread on which the lamp cap 2 is screwed. The lamp cap is locked against working loose by means of glue. The flange 6 is supported in the longitudinal direction of the tubular part 7 by ribs 9 which project inwardly from the housing. The housing 1 is retained between the flange 6 and the lamp cap 2, while in this embodiment the flange 6 is still present within the housing 1. A lamp holder 3 has a flange 10 (both shown in a side elevation) and is recessed within tubular part 7. The flange 10 bears on the flange 6. Projections 11 on the flange 6 project through the flange 10. The flange 10 is locked by scraping rings 12. Current conductors 16*a* are connected to the secondary of the transformer 4 and the lamp holder 3 for a low-voltage lamp, while current conductors 16 are connected to the primary of the transformer and to the lamp cap 2 which is destined to be incorporated in a line voltage lamp holder. The current conductors are guided inwardly through an elongate aperture 13 in the tubular part 7. The housing 1 has a projection 14 which engages in a groove 15 in the assembly member to lock said parts against mutual rotation.

The assembly of the adaptor is very simple. The transformer 4 is positioned in generally concentric relationship to the tubular part 7. The current conductors 16 and 16*a* are inserted through the aperture 13 upwards and downwards, respectively. The conductors 16*a* are connected to the lamp holder 3 and same is placed with its flange 10 over the projections 11 and locked by means of the rings 12. The housing 1 is then installed and one of the current conductors 16 is bent outwardly around the lower edge of the housing. A lamp cap 2 is internally provided with glue and screwed on to the end 8 until the lamp cap 2 abuts against the housing 1 and the flange 6 abuts against the ribs 9. Finally the current conductor 16 to the bottom contact of the lamp cap 2 is attached to said contact and, if desired, the connection to the current conductor 16 with the side contact of the lamp cap 2 is ensured, for example, by means of solder.

The assembly of the adaptor requires only very little time and few components while nevertheless a very rigid construction is obtained. A 6 volt 15 watt halogen incandescent lamp reflector unit having a BAY 15*d* lamp cap was placed in the lamp holder 3 the reflector of which was sealed by means of a clear cover glass. When connected to a lamp holder at 220 V, the lamp provided a beam having a width of 2×3°. A screening cap was placed over the upper edge of the housing so as to prevent stray radiation. The housing of the adaptor was manufactured from quartz powder-filled phenol-formaldehyde, the assembly member was manufactured from glass fiber-reinforced polyester, while the lamp holder and its flange consisted mainly of nickel-coated brass.

Figure 2:
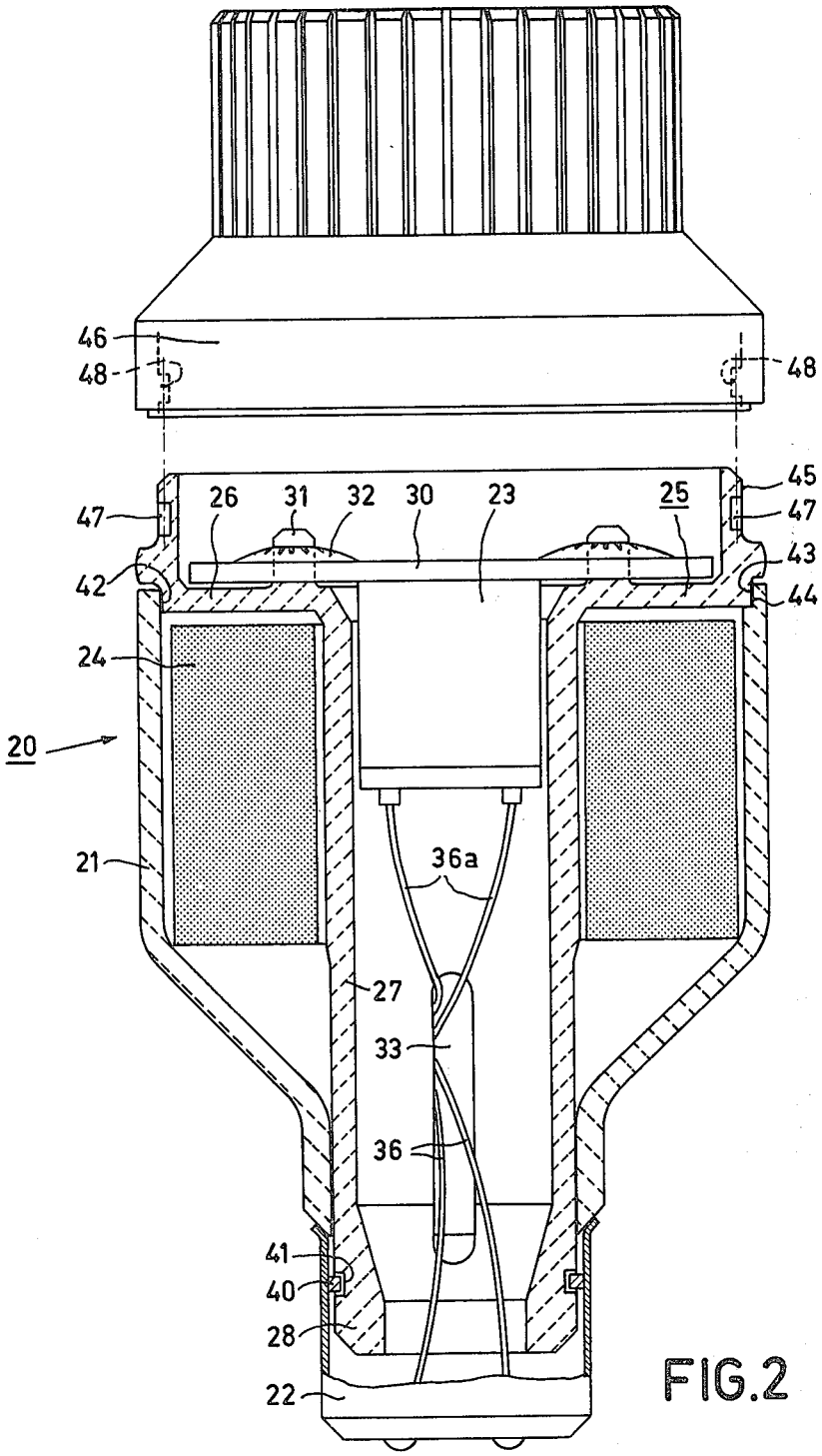
FIG. 2 shows a second embodiment for the greater part as a longitudinal sectional view and with a screening cap in a side elevation.

In FIG. 2 parts corresponding to parts of FIG. 1 have reference numerals which are 20 integers higher.

The flange 26 of the assembly member 25 extends up to the outer surface of the housing 21. As a result of this, housing and flange are kept centered. Locally the flange 26 has projections 43 which engage in recesses 44 in the housing 21. Assembly member 25 and housing 21 are thus locked against mutual rotation.

In the end 28 of the assembly member 25 a circumferential groove 41 is provided in which a resilient metal split ring 40 is incorporated which engages the Swan lamp cap 22 in a clamping manner and which is blocked to rotate by a projection present in the groove. The lamp cap 22 and the ring 40 are connected together by welding.

The flange 26 of the assembly member 25 has a collar 45 around which a screening cap 46 can be placed. Means to couple a screening cap 46 to the adaptor are referenced 47 and 48.

The adaptor 20 can rapidly and easily be assembled in a manner which is comparable to that of the adaptor shown in FIG. 1. In this case too, the housing 21 is retained between the lamp cap 22 and (the flange 26 of) the assembly member 25.

What is claimed is:

1. An adaptor for a low-voltage lamp comprising a housing having at one end a lamp cap for connecting the adaptor to a line voltage lamp holder, and also comprising a lamp holder for a low-voltage lamp, in which housing a transformer is incorporated, the primary of which is connected to the lamp cap by current conductors and the secondary of which is connected to the lamp holder by current conductors, characterized in that the transformer is a ring core transformer and that an assembly member is provided which has a tubular part and an integral flange at one end, which assembly member carries the lamp holder and is partly contained in the housing, the tubular part of which assembly member is surrounded by the transformer and at its end remote from the flange projects through an aperture in the housing and is there secured to the lamp cap, the flange of the assembly member bearing against the housing in the longitudinal direction of the tubular part so that the housing is retained in position by the lamp cap and the flange.

2. An adaptor as claimed in claim 1, wherein the lamp cap is screwed to the end of the tubular part projecting from the housing.

3. An adaptor as claimed in claim 1, wherein the flange of the assembly member is present partly outside the housing.

4. An adaptor as claimed in claim 3, wherein means are provided to center the housing relative to the flange.

5. An adaptor as claimed in claim 1, wherein the lamp holder is recessed in the tubular part of the assembly member.

6. An adaptor as claimed in claim 5, wherein the lamp holder has a flange which is attached to the flange of the assembly member.

7. An adaptor as claimed in claim 1, wherein the flange of the assembly member has a collar to receive a screening cap.

8. An adaptor as claimed in claim 7, wherein the collar has means arranged to form a coupling together with means on a screening cap.

9. An adaptor as claimed in any of the preceding claims, characterized in that the tubular part of the assembly member has an aperture in its wall through which current conductors are passed.

* * * * *